US009133072B1

(12) United States Patent
Strong et al.

(10) Patent No.: US 9,133,072 B1
(45) Date of Patent: Sep. 15, 2015

(54) TACTICAL CAPSULE CHARGE SYSTEM

(71) Applicants: Peter Strong, Morristown, NJ (US); Stephen Roberts, Randolph, NJ (US); Samantha Blais, Morristown, NJ (US); Yao Chen, Brooklyn, NY (US); Leon Moy, Montclair, NJ (US)

(72) Inventors: Peter Strong, Morristown, NJ (US); Stephen Roberts, Randolph, NJ (US); Samantha Blais, Morristown, NJ (US); Yao Chen, Brooklyn, NY (US); Leon Moy, Montclair, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 288 days.

(21) Appl. No.: 13/847,560

(22) Filed: Mar. 20, 2013

(51) Int. Cl.
*C06C 5/06* (2006.01)
*F42D 1/04* (2006.01)

(52) U.S. Cl.
CPC .. *C06C 5/06* (2013.01); *F42D 1/043* (2013.01)

(58) Field of Classification Search
CPC ..... C06C 5/06; C06C 5/00; F42D 1/043
USPC ..... 102/302, 311, 312, 275.11, 275.12, 102/275.7
See application file for complete search history.

(56) References Cited

U.S. PATENT DOCUMENTS 3,878,785 A * 4/1975 Lundborg ..... 102/275.4
5,747,722 A * 5/1998 Gladden et al. ..... 102/275.11

FOREIGN PATENT DOCUMENTS

EP 385 614 A2 * 9/1990

* cited by examiner

*Primary Examiner* — Stephen M Johnson
(74) *Attorney, Agent, or Firm* — Henry S. Goldfine

(57) ABSTRACT

A tactical capsule charge system includes a plurality of plastic containers connected serially, mechanically, and explosively by detonating cord. Each plastic container contains composition C-4 that is detonated by the detonating cord that passes through the interior of the container. The quantity of PETN inside the container is enhanced by tying a knot in the detonating cord in the interior of the container or by wrapping the detonating cord in the interior of the container with PETN sheet. Any number of containers may be used and they may be spaced along the detonating cord at any desired interval.

16 Claims, 5 Drawing Sheets

Fig. 6
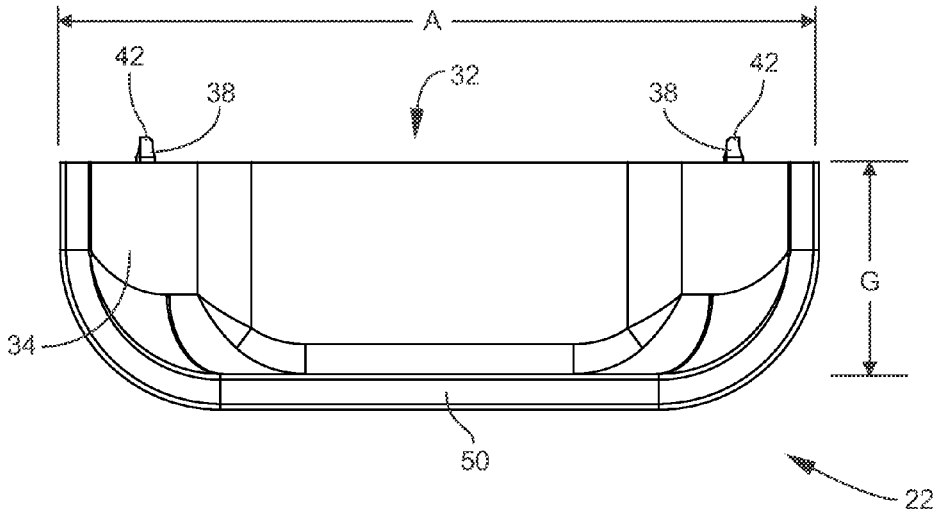
Fig. 8
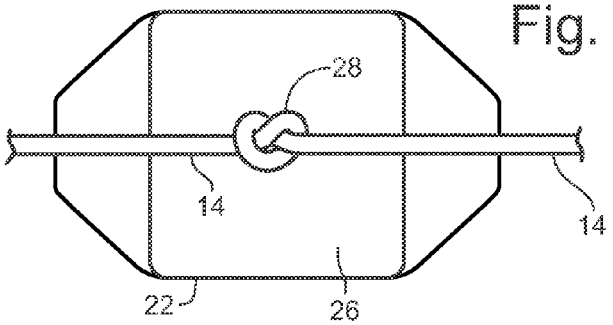
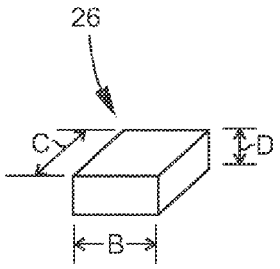
Fig. 7
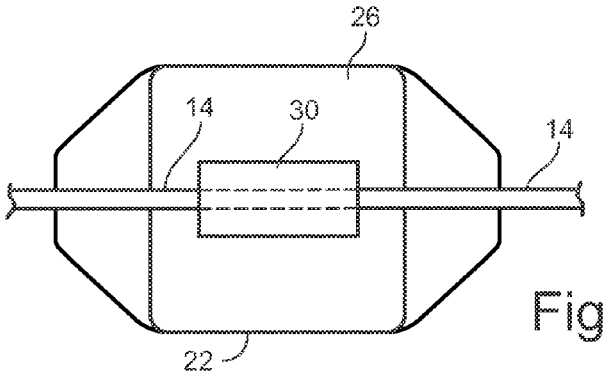
Fig. 9

TACTICAL CAPSULE CHARGE SYSTEM

STATEMENT OF GOVERNMENT INTEREST

The inventions described herein may be manufactured, used and licensed by or for the United States Government.

BACKGROUND OF THE INVENTION

The invention relates in general to munitions and in particular to explosives.

Chokepoints are narrow passages through which traffic moves. The traffic may be pedestrian or vehicular or both. In hostile situations, chokepoints are often locations for ambushes and/or for seeding with explosives, such as Improvised Explosive Devices (LEDs). Examples of chokepoints include bridges, alleys, and doorways. Chokepoints may also be naturally-occurring narrow passages in land or other formations. Hazards at chokepoints, such as hidden explosives, have long been a problem in warfare and especially in recent conflicts.

Known "line clearance" or "line" charges may be used to explosively clear a chokepoint. A Mine Clearing Line Charge (MICLIC) is a mine clearing device used to clear a path for tanks, vehicles, and personnel through minefields or other obstacles. The MICLIC line charge is propelled by a 5-inch rocket motor and then detonated, clearing a vehicle lane that is 100 meters long and 8 meters wide. An Antipersonnel Obstacle Breaching System (APOBS) is an explosive line charge system used to breach antipersonnel minefields and multi-strand wire obstacles. It is carried by two soldiers with backpacks. The APOBS rocket is fired from a 35 meter standoff position, clearing a footpath up to 45 meters long. A Man Portable Line Charge (MPLC) is a rocket-launched detonation cord that clears a 20 meter long footpath. The MPLC can be carried in one backpack.

Known line charges are generally used to sympathetically detonate explosive hazards such as mines and IEDs. Most of the known line charges are intended to clear long distances. The known line charges can be a burden to transport. At a minimum, a separate backpack may be required for each line charge. Sometimes, a separate vehicle may be required for each line charge. One reason for the large weight of line charges is that many line charge systems are made with metal. Another disadvantage of the use of metal in line charges is the creation of metal fragments that are dangerous to personnel and equipment. Metal fragments may also contaminate the soil. In some cases, it is more desirable to disable an explosive hazard or to mark and circumvent an explosive hazard rather than to sympathetically detonate the explosive hazard using a known line charge.

There is a need for a lightweight apparatus for exposing explosive hazards at chokepoints.

SUMMARY OF INVENTION

One aspect of the invention is an apparatus that includes a plastic container having a central longitudinal axis, a pair of axially opposed ends, an interior, and a circular opening in each axially opposed end centered on the central longitudinal axis. The plastic container encloses the interior except for the circular openings. The plastic container has two mating halves. The circular openings in the axially opposed ends are defined by adjacent semi-circular openings in the two mating halves.

A detonating cord containing pentaerythritol tetranitrate (PETN) extends through the circular opening in one axially opposed end, the interior of the container, and the circular opening in the other axially opposed end. A high explosive is disposed in the interior of the container and surrounds the detonating cord. A total quantity of PETN in the interior is greater than a quantity of PETN contained in a piece of the detonating cord having a length equal to a distance between the circular openings in the axially opposed ends.

In one embodiment, a knot is formed in the detonating cord in the interior of the plastic container.

In another embodiment, the detonating cord extends substantially linearly along the central longitudinal axis between the axially opposed circular openings and PETN sheet is wrapped around the detonating cord in the interior of the plastic container.

The high explosive may be composition C-4 explosive.

Each mating half may include a central storage portion and opposed external tapered portions that abut the central storage portion and taper inwardly away from the central storage portion. Each mating half may include opposed internal tapered portions that taper outwardly from respective semi-circular openings toward the central storage portion. Each mating half may include a pair of diagonally opposed tabs and a pair of diagonally opposed ribs fixed in interiors of the opposed external tapered portions. Ends of the pair of diagonally opposed tabs of each mating half may extend into the interiors of the opposed external tapered portions of the other mating half.

At least one mating half may include a removable insert disposed in the central storage portion. The insert may include longitudinal sides that define a storage volume therebetween. The storage volume may be about one half a volume of the central storage portion.

The central storage portion of each mating half may include a recessed portion. The recessed portion may include a longitudinal axis that is parallel to the central longitudinal axis of the plastic container.

Another aspect of the invention is a charge system that includes a plurality of the above-described plastic containers connected in series by the detonating cord. An initiator may be connected to a free end of the detonating cord.

In another aspect, a method of making a charge system includes providing detonating cord, composition C-4 explosive, and a plurality of mating halves of a plastic container. Each mating half has a central longitudinal axis, a pair of axially opposed ends, an interior, and a semi-circular opening in each axially opposed end centered on the central longitudinal axis.

The method includes placing the composition C-4 explosive in the respective interiors of two mating halves and then closing the two mating halves together around the detonating cord such that the detonating cord extends through a pair of circular openings formed by abutting the semi-circular openings of the two mating halves.

The two mating halves are then secured together. A plurality of the plastic containers may be connected mechanically and explosively in series by the detonating cord.

In one embodiment, the method may include forming a knot in the detonating cord and closing the two mating halves together around the knot in the detonating cord.

In another embodiment, the method may include wrapping PETN sheet around the detonating cord and closing the two mating halves together around the PETN sheet wrapped around the detonating cord.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 6 is a side view of FIG. 5.

FIG. 7 is a schematic drawing of a piece of composition C-4 explosive.

FIG. 8 is a schematic drawing of a knotted detonating cord in a mating half of a plastic container.

FIG. 9 is a schematic drawing of PETN sheet wrapped around detonating cord in a mating half of a plastic container.

DETAILED DESCRIPTION

A novel tactical capsule charge system clears surface clutter at chokepoints and exposes explosive hazards at chokepoints. Clearing the surface clutter increases the effectiveness of explosive detectors. The tactical capsule charge system is not designed to sympathetically detonate the explosive hazard. The capsule charge system is lighter in weight and more mobile than known tactical charge systems. The explosive output of the charge system may be easily varied by varying the number of capsules in the charge system. The capsules are plastic containers that contain explosive material, such as composition C-4.

A capsule may be as small as about four inches by two inches by two inches. One or a plurality of capsules may be used. The length of the path cleared may be varied by adding more capsules in series. The explosive output per capsule may be varied by using volume-reducing inserts that provide a contained volume for a reduced amount of C-4 explosive. The charge system can be emplaced in many different ways including, but not limited to, hand emplacement, hand thrown, robotic emplacement, etc.

Each capsule is a plastic container that is composed of a pair of plastic mating shells or container halves. The number of containers used for a particular charge system is tailored to the needs of a particular situation. A removable insert for each mating half is used to vary the contained volume for C-4 explosive. In one embodiment, the removable insert reduces the contained volume by about one half.

Figure 1:
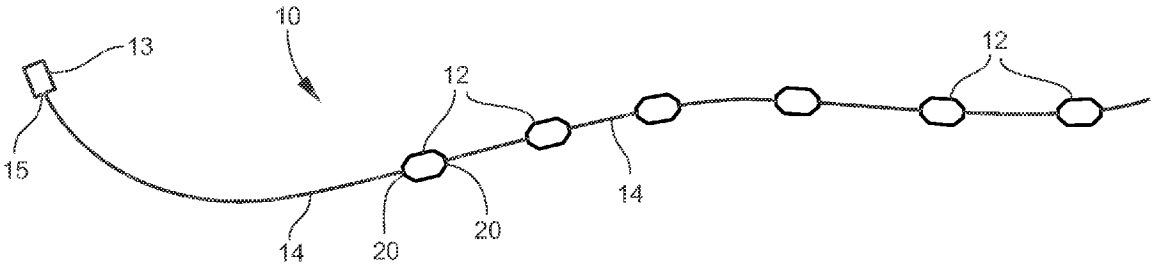
FIG. 1 is a schematic drawing of one embodiment of a charge system.

FIG. 1 is a schematic drawing of one embodiment of a tactical capsule charge system 10 having a plurality of capsules or plastic containers 12 that are mechanically and explosively connected in series with detonating cord 14. An initiator 13 may be disposed at a free end 15 of detonating cord 14 to initiate cord 14. Detonating cord 14 passes through openings 20 in opposed ends of containers 12.

An exemplary detonating cord 14 has a core of pentaerythritol tetranitrate (PETN) surrounded by plastic material. In one embodiment, detonating cord 14 has an outside diameter of about 0.197 inches and 50 grains/foot of PETN. Plastic containers 12 contain a high explosive, for example, composition C-4. Composition C-4 may not detonate effectively unless it is in a contained volume. Containers 12 may be spaced apart along detonating cord 14 any distance. In one embodiment, containers 12 are separated by about 6-18 inches of detonating cord 14. FIG. 1 shows six containers 12. However, a single container 12 may be used or any number of containers 12 may be serially connected with cord 14.

Figure 2:
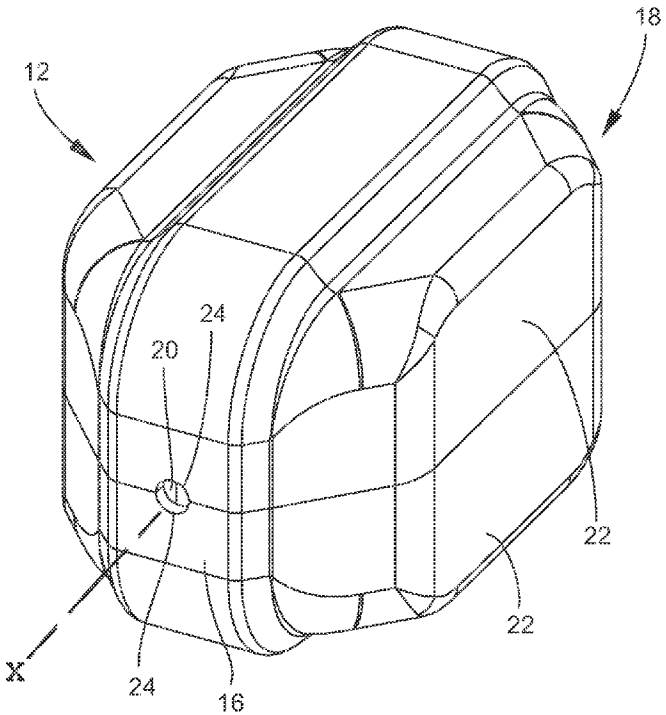
FIG. 2 is a perspective view of one embodiment of a plastic container used in the charge system of FIG. 1.
Figure 3:
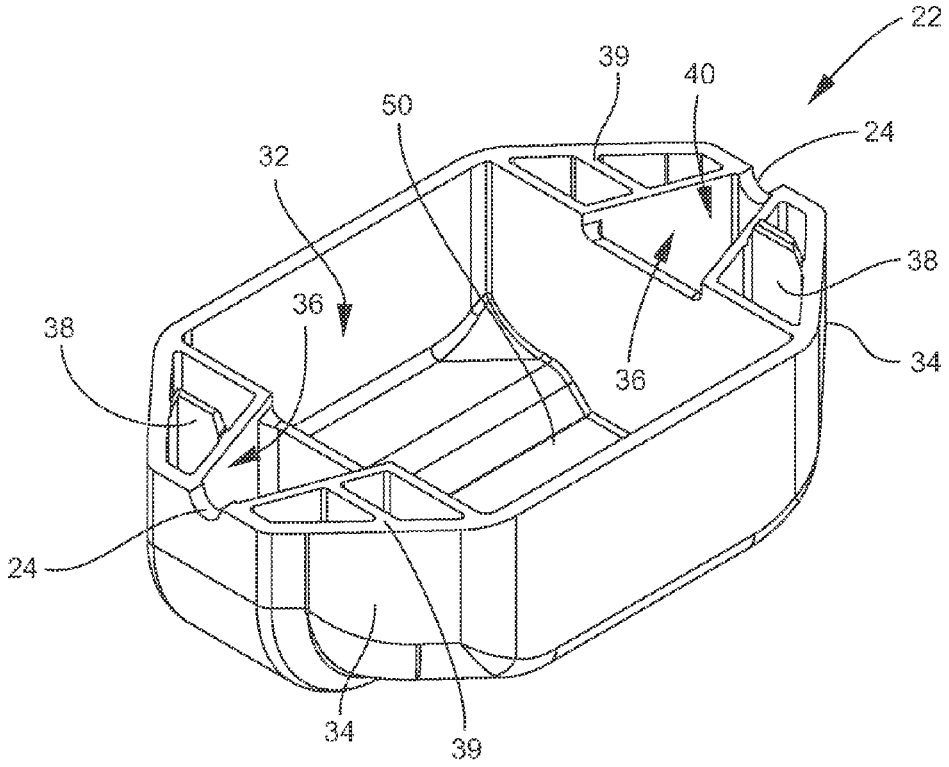
FIG. 3 is a perspective view of one of the mating halves of the plastic container of FIG. 2.

FIG. 2 is a perspective view of one embodiment of a plastic container 12 used in charge system 10. Plastic container 12 has a central longitudinal axis X, a pair of axially opposed ends 16, 18, an interior (not seen in FIG. 2), and a circular opening 20 in each axially opposed end 16, 18. Circular openings 20 are centered on central longitudinal axis X. Plastic container 12 encloses its interior, except for circular openings 20. Container 12 has two mating halves 22, 22. Circular openings 20 in axially opposed ends 16, 18 are defined by adjacent semi-circular openings 24, 24 in two mating halves 22, 22.

Detonating cord 14 extends through circular opening 20 in one axially opposed end 16, through the interior of container 12, and out of circular opening 20 in axially opposed end 18. A high explosive, such as composition C-4, is disposed in the interior of container 12 and surrounds detonating cord 14 in container 12. A piece of PETN detonating cord 14 having a length equal to a distance A (FIG. 6) between circular openings 20 in axially opposed ends 16, 18 may not be sufficient to detonate the C-4 in the interior of container 12. Thus, additional PETN is added so that the total quantity of PETN in the interior of container 12 is greater than the quantity of PETN contained in a piece of detonating cord 14 having a length equal to distance A.

As shown schematically in FIG. 8, in one embodiment, the additional PETN may be supplied by tying a knot 28 in a portion of detonating cord 14 that is in the interior of plastic container 12. Knot 28 may be, for example, a double overhand knot. In another embodiment, as shown schematically in FIG. 9, the additional PETN may be supplied by wrapping PETN sheet 30 around a portion of detonating cord 14 that is in the interior of plastic container 12. PETN sheet is available in 0.25 inch thickness. In FIG. 9, detonating cord 14 extends substantially linearly along central longitudinal axis X between axially opposed circular openings 20.

Figure 4:
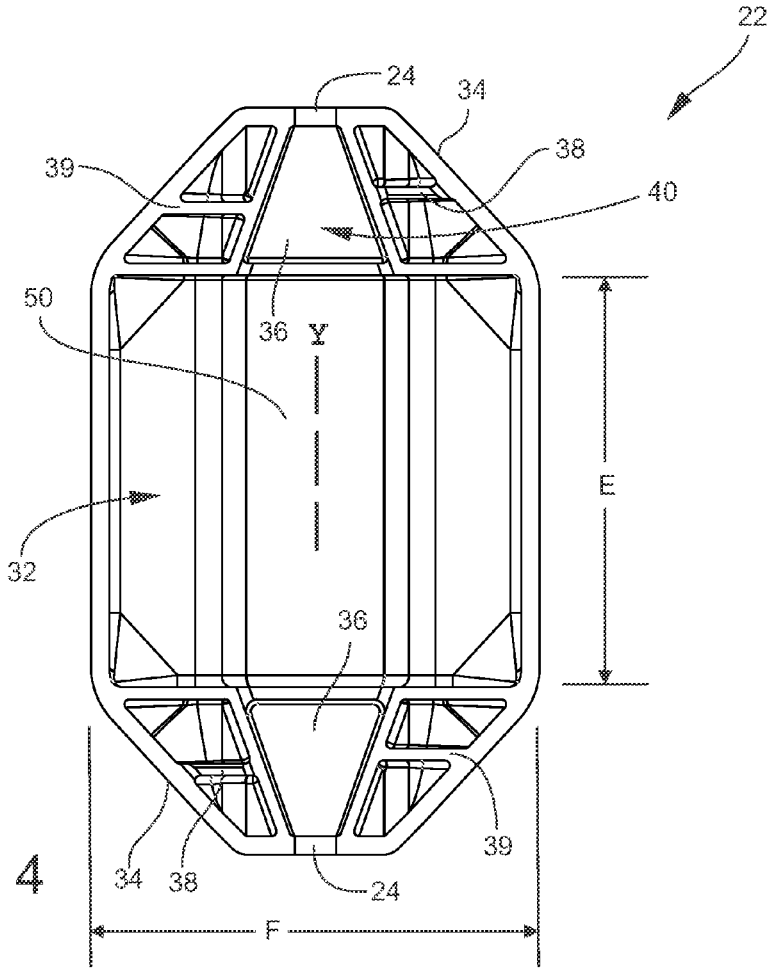
FIG. 4 is a top view of FIG. 3.
Figure 5:
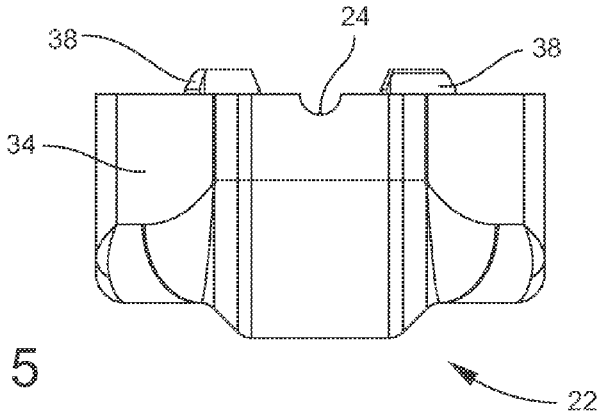
FIG. 5 is an end view of FIG. 4.

In one embodiment of container 12, dimensions E, F, G (FIGS. 4 and 6) are about two inches, two inches, and one inch, respectively. In this size of container 12, the additional amount of PETN supplied by knot 28 or PETN sheet 30 is about three times the amount of PETN in a piece of detonating cord 14 having a length A. In general, one may increase dimensions E, F, or G without a corresponding increase in the amount of additional PETN because once the minimum amount of PETN needed to detonate the C-4 is supplied, that amount of PETN will also detonate a larger amount of enclosed C-4. In addition to increasing the amount of PETN in container 12, knot 28 or PETN sheet 30 also advantageously hinders axial translation of detonating cord 14 with respect to container 12.

Referring to FIGS. 3-6, each mating half 22 of container 12 includes a central storage portion 32. The central storage portions 32 of two mating halves 22 that form container 12 define the enclosed volume of container 12 that is filled with C-4. For maximum effectiveness, the C-4 should completely fill the enclosed volume. A pair of opposed external tapered portions 34 abut central storage portion 32 and taper inwardly away from central storage portion 32. Each mating half 22 includes a pair of opposed internal tapered portions 36 that taper outwardly from respective semi-circular openings 24 toward central storage portion 32.

Each mating half 22 includes a pair of diagonally opposed tabs 38 and a pair of diagonally opposed ribs 39. Tabs 38 and ribs 39 are fixed in interiors 40 of respective opposed external tapered portions 34. A rib 39 is disposed transverse to each tab 38. Ends 42 of the pair of diagonally opposed tabs 38 of each mating half 22 extend into the interiors 40 of opposed external tapered portions 34 of the other mating half 22. Ribs 39 and tabs 38 function as alignment aids when assembling two mating halves 22, 22 to form container 12.

Central storage portion 32 of each mating half 22 includes a recessed portion 50. Recessed portion 50 includes a longitudinal axis Y (FIG. 4) that is parallel to central longitudinal axis X. Recessed portion 50 enables C-4 placed in central storage portion 32 to expand into recessed portion 50 when two mating halves 22, 22 are closed together around detonating cord 14. The detonating cord 14 disposed in the two mating halves 22 may include knot 28 or may be wrapped with PETN sheet 30.

Figure 10:
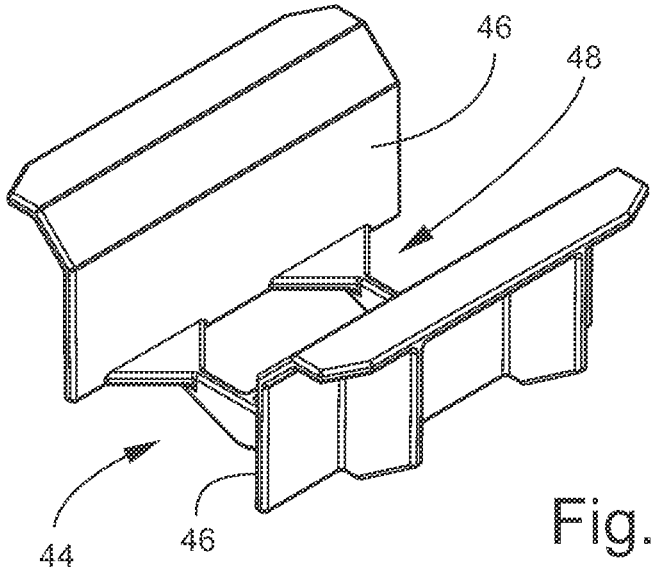
FIG. 10 is a perspective view of one embodiment of an insert for a mating half of a plastic container.

To create a smaller enclosed volume for C-4 in central storage portion 32, an insert 44 (FIG. 10) may be disposed in central storage portion 32. Insert 44 has longitudinal sides 46 that define a storage volume 48 therebetween. In one embodiment, storage volume 48 is about one-half the volume of central storage portion 32. The smaller volume 48 created by insert 44 may be desirable when less C-4 is needed for a particular scenario. An insert 44 may be disposed in one or both mating halves 22, 22 of container 12.

Charge system 10 may be constructed in the following manner. First, one may choose to use knots 28 in cord 14 or to use PETN sheet 30 wrapped around cord 14. If knots 28 are used, then knots 28 are tied in cord 14 at spaced-apart intervals corresponding to the desired spacing of plastic containers 12. If knots 28 are not used, then PETN sheet 30 is wrapped around cord 14 at spaced-apart intervals corresponding to the desired spacing of plastic containers 12. Of course, one could use a knot 28 at one location on cord 14 and PETN sheet 30 at another location on cord 14.

Next, a piece 26 (FIG. 7) of composition C-4 is placed in each central storage portion 32 of a pair of mating halves 22, 22. In one embodiment, the piece 26 of C-4 weighs about 0.25 pounds and is about two inches wide, two inches long, and one inch thick. Because C-4 is available in two inch by one inch by ten inch rectangular blocks, one may simply slice two inch pieces from a block of C-4. The dimensions E, F, G (FIGS. 4 and 6) of central storage portion 32 may be about two inches, two inches, and one inch, respectively.

Then, detonating cord 14 with either knot 28 or PETN sheet 30 wrapped around it is placed on the piece 26 of C-4 in one of the mating halves 22 and cord 14 is aligned so that it rests in semi-circular openings 24 at opposed ends of mating half 22. The task of aligning cord 14 is greatly simplified by opposed internal tapered portions 36. The two mating halves 22, 22 are then closed together so that the respective semi-circular openings 24, 24 on each half 22 are aligned to create circular openings 20 of container 12. The process of aligning mating halves 22, 22 is facilitated by diagonally opposed tabs 38 and ribs 39. Closing together the mating halves 22, 22 causes the pieces 26, 26 of C-4 to deform around cord 14, and also around knot 28 or PSTN sheet 30 wrapped around cord 14. The C-4 also deforms into each recessed portion 50 of mating halves 22, 22.

Mating halves 22, 22 may be secured together using, for example, tape wrapped transversely around the mating halves. Other securing methods may also be used.

As many additional containers 12 as desired are then formed as described above to create a charge system 10 having a plurality of containers 12 mechanically and explosively connected in series by cord 14. Initiator 13 is fixed to free end 15 of cord 14 to detonate charge system 10.

Charge system 10 may be, for example, placed by hand or robot or thrown by hand. In some cases, charge system 10 may be thrown, similar to a lasso, ahead of the area to be cleared. Then, containers 12 may be pulled back into the area to be cleared using free end 15 of cord 14 to thereby straighten out cord 14 and properly position containers 12. In this regard, opposed external tapered portions 34 help prevent containers 12 from getting snagged or hung-up while dragging. In addition, the external surface of container 12 includes smooth radii and curved contours, rather than sharp corners, to help prevent snagging.

Another important advantage of the invention is the greatly decreased shipping hazard of charge system 10, compared to known line charges. Detonating cord 14 and composition C-4 are available separately and may be shipped and transported separately. Only at the area of use of charge system 10 is it necessary to place the C-4 into direct contact with the detonating cord 14.

While the invention has been described with reference to certain embodiments, numerous changes, alterations and modifications to the described embodiments are possible without departing from the spirit and scope of the invention as defined in the appended claims, and equivalents thereof.

What is claimed is:

1. An apparatus, comprising:

a plastic container having a central longitudinal axis, a pair of axially opposed ends, an interior, and a circular opening in each axially opposed end centered on the central longitudinal axis, the plastic container enclosing the interior except for the circular openings and having two mating halves, the circular openings in the axially opposed ends being defined by adjacent semi-circular openings in the two mating halves;

a detonating cord containing pentaerythritol tetranitrate (PETN) and extending through the circular opening in one axially opposed end, the interior of the container, and the circular opening in the other axially opposed end; and a high explosive disposed in the interior of the container and surrounding the detonating cord;

wherein a total quantity of PETN in the interior is greater than a quantity of PETN contained in a piece of the detonating cord having a length equal to a distance between the circular openings in the axially opposed ends.

2. The apparatus of claim 1, further comprising a knot formed in the detonating cord in the interior of the plastic container.

3. The apparatus of claim 1, wherein the detonating cord extends substantially linearly along the central longitudinal axis between the axially opposed circular openings, the apparatus further comprising PETN sheet wrapped around the detonating cord in the interior of the plastic container.

4. The apparatus of claim 1, wherein the high explosive is composition C-4 explosive.

5. The apparatus of claim 1, wherein each mating half includes a central storage portion and opposed external tapered portions that abut the central storage portion and taper inwardly away from the central storage portion.

6. The apparatus of claim 5, wherein each mating half includes opposed internal tapered portions that taper outwardly from respective semi-circular openings toward the central storage portion.

7. The apparatus of claim 6, wherein each mating half includes a pair of diagonally opposed tabs and a pair of diagonally opposed ribs fixed in interiors of the opposed external tapered portions.

8. The apparatus of claim 7, wherein ends of the pair of diagonally opposed tabs of each mating half extend into the interiors of the opposed external tapered portions of the other mating half.

9. The apparatus of claim 5, wherein at least one mating half further comprises a removable insert disposed in the central storage portion, the insert including longitudinal sides that define a storage volume therebetween.

10. The apparatus of claim 9, wherein the storage volume is one half a volume of the central storage portion.

11. The apparatus of claim 5, wherein the central storage portion of each mating half includes a recessed portion.

12. The apparatus of claim 11, wherein the recessed portion includes a longitudinal axis that is parallel to the central longitudinal axis of the plastic container.

13. A charge system, comprising a plurality of the apparatus of claim 1 connected in series by the detonating cord.

14. The charge system of claim 13, further comprising an initiator connected to a free end of the detonating cord.

15. An apparatus, comprising:

a plastic container having a central longitudinal axis, a pair of axially opposed ends, an interior, and a circular opening in each axially opposed end centered on the central longitudinal axis, the plastic container enclosing the interior except for the circular openings and having two mating halves, the circular openings in the axially opposed ends being defined by adjacent semi-circular openings in the two mating halves;

each mating half including a central storage portion, opposed external tapered portions that abut the central storage portion and taper inwardly away from the central storage portion, opposed internal tapered portions that taper outwardly from the semi-circular openings toward the central storage portion, a pair of diagonally opposed tabs fixed in interiors of the opposed external tapered portions, and a pair of diagonally opposed ribs fixed in the interiors of the opposed external tapered portions, wherein ends of the pair of diagonally opposed tabs of each mating half extend into the interiors of the opposed external tapered portions of the other mating half;

detonating cord containing pentaerythritol tetranitrate (PETN) and extending through the circular opening in one axially opposed end, the interior of the container, and the circular opening in the other axially opposed end; and composition C-4 disposed in the interior of the container and surrounding the detonating cord;

wherein a total quantity of PETN in the interior is greater than a quantity of PETN contained in a piece of the detonating cord having a length equal to a distance between the circular openings in the axially opposed ends.

16. A charge system, comprising a plurality of the apparatus of claim 15 connected in series by the detonating cord.

* * * * *